US005278556A

United States Patent [19]

Oh

[11] Patent Number: 5,278,556

[45] Date of Patent: Jan. 11, 1994

[54] REMOTE CONTROLLED LIGHT EMITTING AUTOMOBILE LOCATING ALARM SYSTEM

[76] Inventor: Kwang J. Oh, 16075 Mapes Ave., Cerritos, Calif. 90701

[21] Appl. No.: 798,236

[22] Filed: Nov. 22, 1991

[30] Foreign Application Priority Data

Nov. 22, 1990 [KR] Rep. of Korea ..... 17999

[51] Int. Cl.[5] ..... G08G 1/123; G08C 19/00

[52] U.S. Cl. ..... 340/988; 340/825.69; 340/825.72; 340/825.49; 340/321

[58] Field of Search ..... 340/988, 539, 825.69, 340/825.72, 825.49, 989, 321

[56] References Cited

U.S. PATENT DOCUMENTS

| | | | |
|---|---|---|---|
| 3,506,956 | 4/1970 | Kolm et al. | 340/825.69 |
| 3,668,526 | 6/1972 | Raskin | 340/825.69 |
| 3,727,228 | 4/1973 | Taylor et al. | 340/825.69 |
| 4,654,659 | 3/1987 | Kubo | 340/825.72 |
| 4,660,033 | 4/1987 | Brandt | 340/825.72 |
| 4,916,584 | 4/1990 | Gustafson | 340/479 |

*Primary Examiner*—Donnie L. Crosland

*Attorney, Agent, or Firm*—Ladas & Parry

[57] ABSTRACT

A remote control light emitting automobile locating alarm system includes a receiver for placement within the automobile, and a remote control unit for energizing the receiver in a cordless fashion. The main unit within the automobile includes a transparent body part which can emit light and is covered with a garment selected from different kinds of animal characters, where light can radiate through the character cover. The animal character figure has appendages which can be moved up and down by a mechanical arrangement, and light bulbs are provided within the transparent body part. Upon actuation of the main unit from the remote control unit, both the mechanical arrangement and the electrical circuit are energized to cause moving motion of light emitting parts of the animal character. If desired, an alarm signal can also be sounded to assist one in locating his/her car regardless of whether or not the area is dark or bright. The moving feature can also make the driver feel more pleasant for having a pet-like toy in the car.

9 Claims, 3 Drawing Sheets

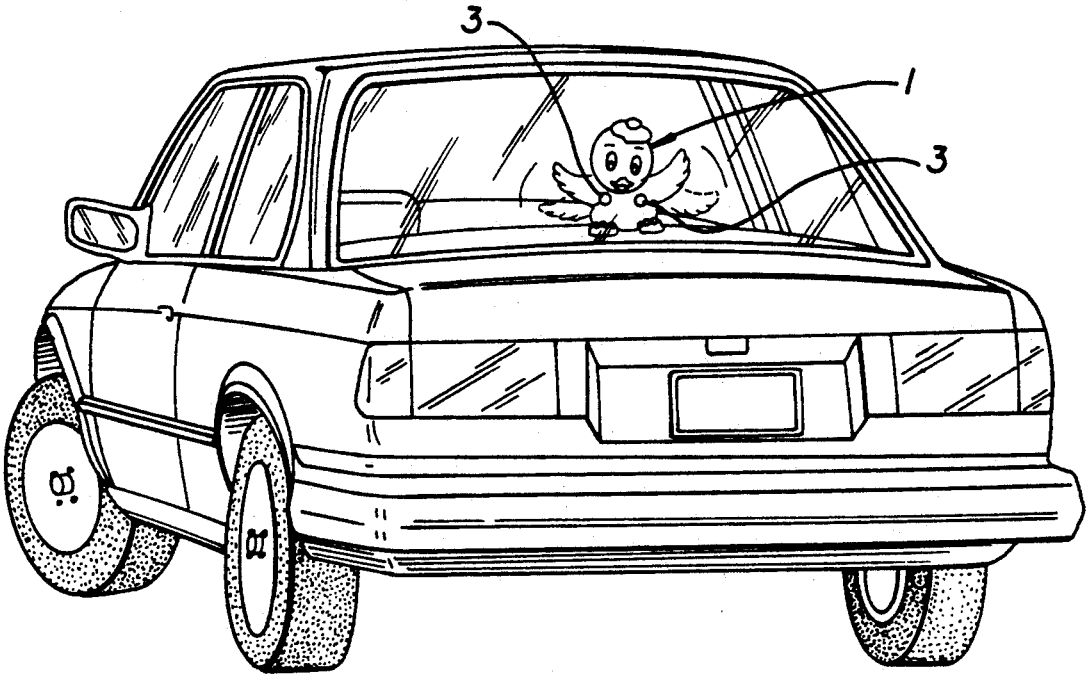
FIG. 1
FIG. 1a
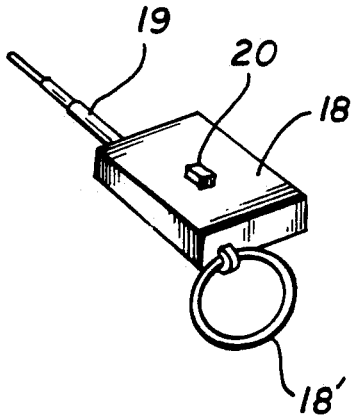
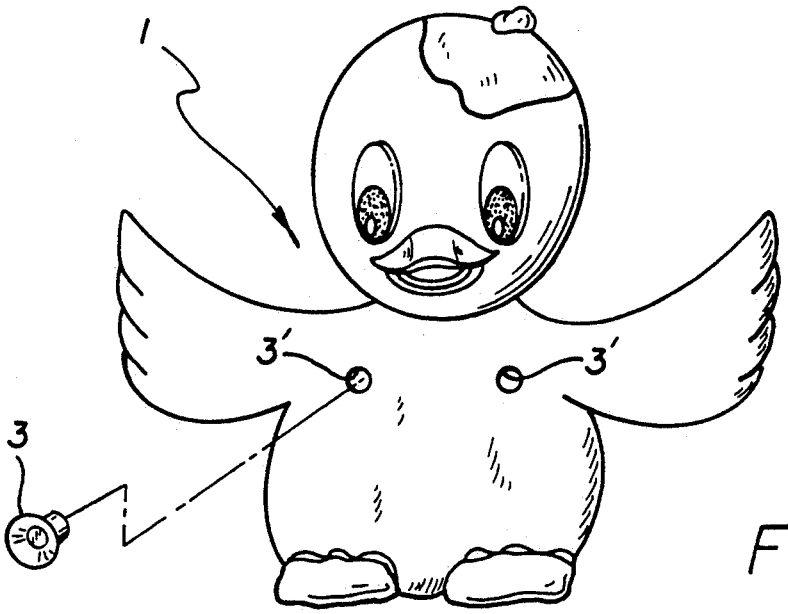
FIG. 2

REMOTE CONTROLLED LIGHT EMITTING AUTOMOBILE LOCATING ALARM SYSTEM

BACKGROUND OF THE INVENTION

1. Field of the Invention

The present invention relates to a remote controlled light emitting automobile locating alarm system.

2. Brief Description of the Prior Art

Until now, it has been difficult for people to find their cars in a dark parking lot, and they easily forget where they have parked their cars. It often makes people confuse their car with similar looking cars and, they can easily waste time looking for their own car.

One conventionally used auto-finder turns the head light on by a cordless remote control system and produces a signal sound. There has been difficulty in installing such a system to the head light circuit wires of an automobile. Also, cars are often parked in a way that the front of the car faces a wall or a building, and in a tight area, small cars would not be visible behind a truck or large-sized cars. Thus, turning on the head light does not help them find their cars easily. The signal sound it produces also cannot be heard from a distance or in a noisy area.

SUMMARY OF THE INVENTION

Therefore, an object of the present invention is to overcome the above-mentioned disadvantages. A transparent body part which can emit light is covered with a garment simulating different kinds of animal characters through which light can radiate. This invention may be installed inside of a car where it can be easily visible, and moving motion of the light emitting parts as well as strong signal sounds can assist one to locate his or her car regardless of whether the area is dark or bright. Its moving feature can also make the driver feel pleasant for having a pet-like toy in the car.

BRIEF DESCRIPTION OF THE DRAWING

The invention will now be described with reference to the accompanying drawings in which:

FIG. 1 is a perspective view of an automobile with a remote controlled light emitting locating alarm system located in the back window thereof in accordance with the present invention;

FIG. 1*a* shows a remote control unit;

FIG. 2 depicts a cover or garment for the locating alarm system in the form of an animal character through which light can be transmitted;

DETAILED DESCRIPTION OF THE PREFERRED EMBODIMENT

Figure 3A:
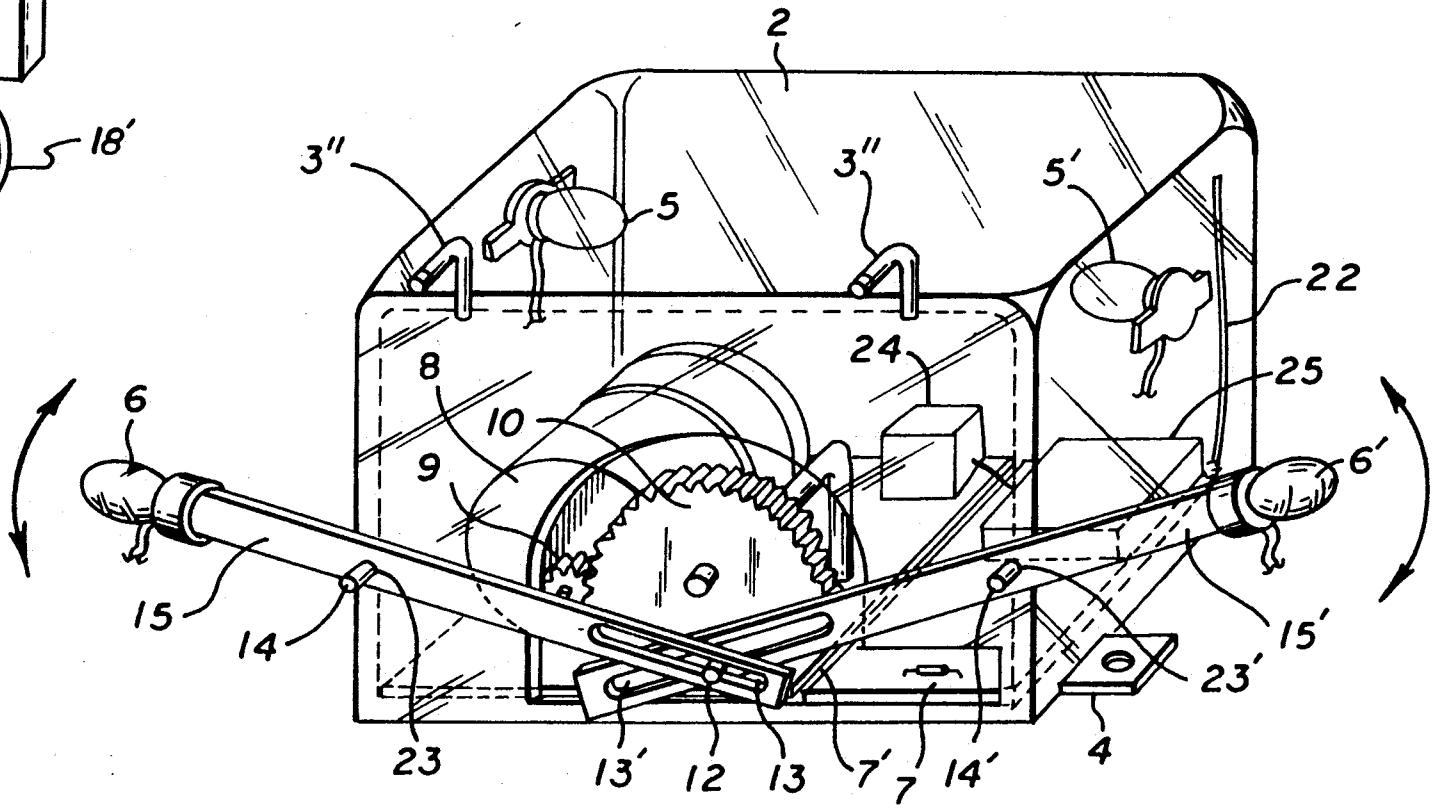
FIG. 3*a* illustrates the inner mechanical arrangement for the system.

In FIGS. 1 and 2, by way of example, the main unit 1 includes an animal character figure used as a cover for the automobile locating alarm system and may have suction cups 3 insertable into holes 3' when the main unit 1 is to be secured to the inside of a window of the automobile.

Referring to FIGS. 3*a*, 3*b*, 4*a* and 4*b*, a transparent body houses, at the bottom thereof, a relay coil 24 which has its bottom terminal connected to one of the contacts of the internal switch 25', the other contact of internal switch 25' being connected to the positive pole of the electrical source 17. Switch contacts 25' are located inside of the cordless signal-receiving system 25. The upper terminal of relay coil 24 is connected to the negative pole of the electrical source, and upon actuation of switch 25', relay 21 is energized. This closes the connection between points A and B in relay 21 and thus supplies positive potential to one side of motor 8, animal character body bulbs 5, 5' and arm bulbs 6, 6'. The other terminals of motor 8 and bulb 5, 5', 6, and 6' are connected directly to the negative pole of the electrical source 17.

Additionally, an external electrical source 16 and an audible alarm 16' are connected in a similar manner but not through relay 21, i.e., the negative terminal of each is connected to the negative pole of electrical source 17, and the positive terminal of each is connected to motor 8 and bulbs 5, 5', 6, and 6'. All connections are made to a circuit board 7 mounted inside of the transparent body 2.

On the left side of the interior of the transparent body 2, motor 8 is fixed in such a manner that the motor gear 9 can engage with the decelerating gear 10 placed in the center of the transparent body 2. An off-centered axle 12 is fixed to the decelerating gear 10, and the guiding slots 13, 13' in both arms 15, 15', receive the off-centered axle 12. Arm axles 14, 14', which are fixed to the front sides of the transparent body 2 can be fitted into the holes 23, 23' in the middle of both arms 15, 15'. The arm bulbs 6, 6' are attached to both ends of the arms 15, 15'. Animal character body bulbs are mounted internally to transparent body 2 on both sides thereof. Finally, the entire transparent body 2 can be covered with a garment in the form of an animal character figure.

The cordless signal-transmitter 18 has a signal-transmitting antenna 19 (FIGS. 1*a*, 3*b*, and 4*a*) and a switch 20 which is connected to the electrical source 17' through the signal-transmitting circuit 18''.

Figure 3B:
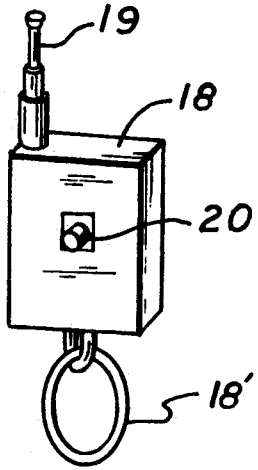
FIG. 3*b* shows a perspective view of the remote control unit.
Figure 4B:
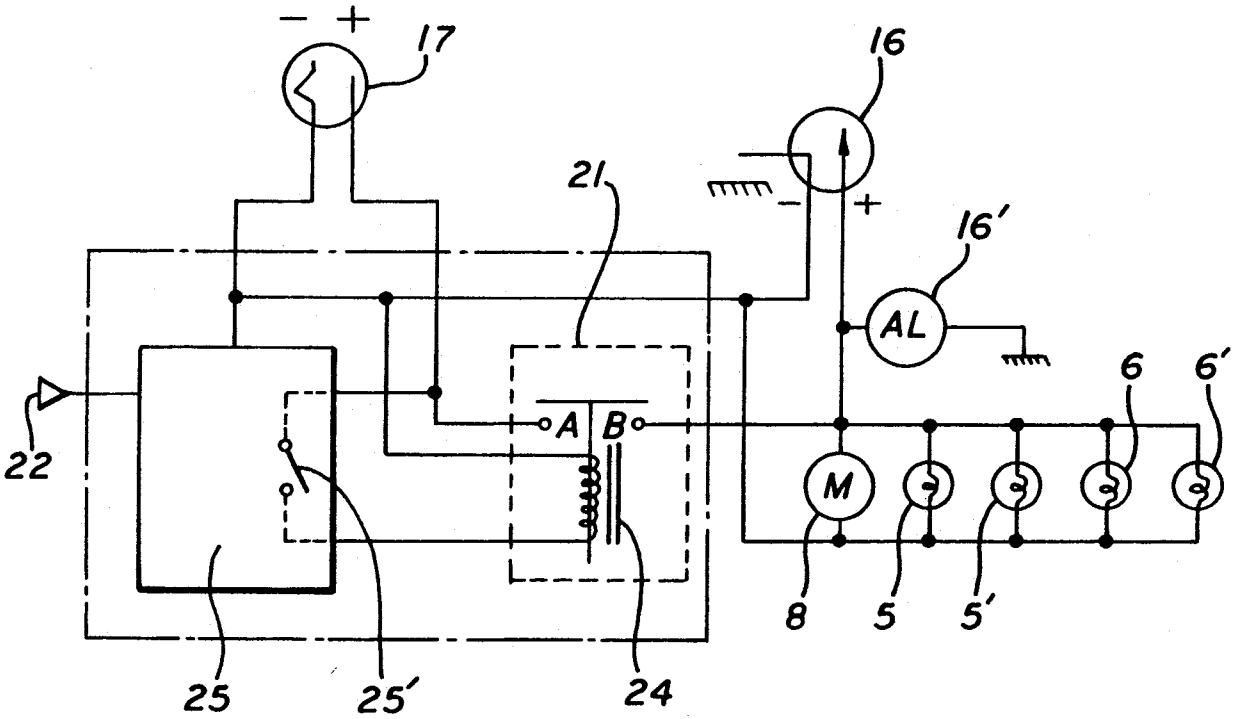
FIG. 4*b* is the electronic circuit which operates within the animal character body.
Figure 4A:
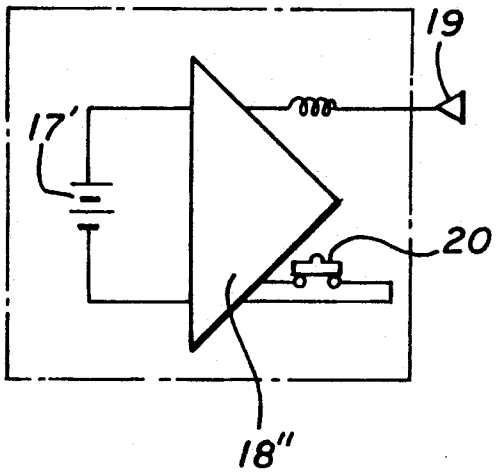
FIG. 4*a* is the electronic circuit which operates within the remote control unit.

In FIGS. 1*a* and 3*b*, the numeral 18' indicates a ring for the portable cordless signal-transmitter, and in FIGS. 3*a* and 4*b*, numeral 22 indicates a cordless signal-receiving antenna.

The function of the remote controlled light emitting automobile locating alarm system in accordance with the present invention will now be described.

When switch 20 on the cordless signal-transmitter 18 is turned on, the source of electricity 17' is coupled to the cordless signal-transmitting circuit 18'', and the signal frequency is transmitted from the cordless signal-transmitting antenna 19 to the signal-receiving antenna 22 in the receiver 25. This results in closure of switch 25' which, in turn, energizes relay 21 as beforedescribed. Points A and B of relay 21 then close and apply positive electrical energy to the character body bulbs 5, 5', and arm bulbs 6, 6' to turn them on instantly. At the same time, motor 8 is energized, and as it turns, the motor gear 9 starts to rotate causing the engaged decelerating gear 10 to rotate as well. The off-centered axle 12 that is attached to the decelerating gear 10 is rotated and is slidable inside the guiding slots 13, 13' of the arms 15, 15' when the decelerating gear 10 rotates. This causes arms 15, 15' to move up and down continuously, while the body bulbs 5, 5' and arm 6, 6' to emit light. The light of the body and the arms is emitted through the garment of the animal character FIG. 1 while the arms 15, 15' move up and down. In addition, when the system is connected to an outside source of electricity 16, such as the turn signal source or brake signal source of electricity in the automobile, all of the above movements and lighting can be initiated under control of the outside source of electricity 16 independent of the operation of the remote control unit 18 energizing relay 21. In such a case, if the terminals 16 are connected to an emergency energy source, this system can be used as a moving signal in case of such emergency. Since the source of electricity comes from the external emergency alarm signal source of electricity 16, an external siren sound signal amplifier can be connected to this system, mounted outside the system, and can be turned on at the same time the main unit 1 of the present invention is activated.

When the suction cups 3 are plugged into the holes 3' in the character figure body 1, it can be used to fix the main unit 1 on an appropriate location of the rear window. The arm movements and alarm system of the present invention can thereby assist people to easily find their own cars at night or in the daytime.

On the transparent body 2, at the upper forward edge thereof, a pair of angled brackets 3'' are provided. The forward ends of the these brackets are accessible through holes 3' in the body of the animal character, and it is on these angled brackets that the suction cups 3 are physically attached and retained.

I claim:

1. A remote controlled light emitting automobile locating alarm system, comprising:

a system main unit for placement in an automobile in a location where visible emission from said main unit are detectable outside the automobile;

mechanical means for effecting mechanical movements of parts of said main unit when energized;

light emitting means for emitting light from said main unit, when energized;

cordless signal-receiving circuit means for receiving cordless transmissions, and for energizing said mechanical means and said light emitting means; and hand-carried remote control signal-transmitting means including switch means for selectively transmitting signals to be received by said signal-receiving circuit means in said main unit.

2. The apparatus as claimed in claim 1, wherein said main unit includes a cover in the form of an animal character figure, said cover having means for permitting light to transmit from internally of said cover to externally thereof.

3. The apparatus as claimed in claim 2, wherein;

said mechanical means includes movable arms;

said animal character figure comprises appendages which are movable by said movable arms which are, in turn, moved up and down by operation of said mechanical means.

4. The apparatus as claimed in claim 3, wherein said light emitting means comprises a pair of light bulbs, one each being connected to the ends of the appendages of said animal character figure.

5. The apparatus as claimed in claim 4, wherein said main unit includes a transparent body within which are mounted body bulbs which light in response to actuation of said light emitting means, said light emitting means serving to light the body portion of the animal character figure to be visible from outside said main unit.

6. The apparatus as claimed in claim 1, wherein said mechanical means includes:

a motor, a gear driven by said motor, and an off-centered axle on said gear; and a pair of arms articulated to said main body and having slots therein for receiving said off-centered axle, such that rotation of said gear moves said off-centered axle in an arc which, in turn, effects said movement of said arms up and down by the action of said off-centered axle sliding within said slots in said arms.

7. A remote-controlled light-emitting automobile locating apparatus comprising:

(a) a system main unit for placement in a location relative to an automobile, which location permits visible emissions from said main unit to be detected outside said automobile, said main unit including a cover in the form of a character figure, said cover permitting light to transmit from internally of said cover to externally thereof;

(b) mechanical means for effecting mechanical movements of parts of said cover;

(c) light emitting means for emitting light from said cover;

(d) cordless signal-receiving circuit means for receiving cordless transmissions and for energizing said mechanical means and said light emitting means; and (e) remote control signal transmitting means for selectively transmitting signals to be received by said signal-receiving means.

8. The apparatus of claim 8, wherein said character figure is an animal character figure.

9. The apparatus of claim 8, wherein said character figure has arms and wherein said mechanical means causes said arms to move.

* * * * *